US006854363B2

(12) United States Patent
Ping

(10) Patent No.: US 6,854,363 B2
(45) Date of Patent: Feb. 15, 2005

(54) RATCHET DRIVER

(75) Inventor: Qiu Jian Ping, Hangzhou (CN)

(73) Assignee: Great Neck Saw Manufacturers, Inc., Mineola, NY (US)

( * ) Notice: Subject to any disclaimer, the term of this patent is extended or adjusted under 35 U.S.C. 154(b) by 0 days.

(21) Appl. No.: 10/776,911

(22) Filed: Feb. 11, 2004

(65) Prior Publication Data

US 2004/0159192 A1 Aug. 19, 2004

Related U.S. Application Data

(63) Continuation of application No. 10/041,046, filed on Jan. 9, 2002, now abandoned.

(51) Int. Cl.[7] ..... B25B 13/46
(52) U.S. Cl. ..... 81/63.1; 192/43.2
(58) Field of Search ..... 81/60, 63.1; 192/43.2

(56) References Cited

U.S. PATENT DOCUMENTS

| | | | |
|---|---|---|---|
| 386,261 | A | 7/1888 | Pederson |
| 391,880 | A | 10/1888 | Cashin |
| 508,706 | A | 11/1893 | Hand |
| 541,130 | A | 6/1895 | Swan |
| 666,512 | A | 1/1901 | Furbish |
| 814,528 | A | 3/1906 | Furbish |
| 850,566 | A | 4/1907 | Cook |
| 855,292 | A | 5/1907 | Ellrich |
| 873,363 | A | 12/1907 | Foss |
| 968,080 | A | 8/1910 | Repass |
| 1,011,782 | A | 12/1911 | Heard |
| 1,132,319 | A | 3/1915 | Fegley |
| 1,421,792 | A | 7/1922 | Linden |
| 1,475,274 | A | 11/1923 | Blood |
| 1,493,353 | A | 5/1924 | Leopold |
| 1,503,047 | A | 6/1924 | Hendrickson |
| 1,508,512 | A | 9/1924 | Farley |
| 2,296,320 | A | 9/1942 | Waldo |

(List continued on next page.)

FOREIGN PATENT DOCUMENTS

| | | |
|---|---|---|
| AU | 487053 | 3/1975 |
| DE | 1906333 | 9/1970 |
| DE | 2513648 | 9/1976 |
| DE | 3705663 | 5/1988 |
| DE | 3909429 | 9/1990 |
| DE | G9208547.4 | 6/1992 |
| DE | G9318291.0 | 3/1994 |
| DE | G9409099.7 | 6/1994 |
| DE | G29514482 | 10/1995 |
| EP | 94115762.0 | 7/1995 |
| GB | 2082103 | 3/1982 |

OTHER PUBLICATIONS

Conrad Baumann—Germany—published 1972 or later.

*Primary Examiner*—James G. Smith
(74) *Attorney, Agent, or Firm*—Joseph J. Previto

(57) ABSTRACT

A ratchet driver having a ratchet control assembly and a driver assembly rotatable relative to the ratchet control assembly. A ratchet sleeve operatively connected to the driver assembly and having inwardly facing first and second control openings. The ratchet control assembly having first and second slots, having first and second stop slides, respectively, mounted therein. Moving mechanism to move the stop slides within the first and second control openings, respectively, stop slide control mechanism movable to a position to move said first stop slide out of the first control opening and allow the second stop slide to be in the second control opening and to move stop slide control means to a position to move the second stop slide out of the second control opening and allow the first stop slide to be in the first control opening, and to move the stop slide control means to a position to allow the first and second stop slides to be in the first and second control openings.

11 Claims, 2 Drawing Sheets

U.S. PATENT DOCUMENTS 2,395,681 A 2/1946 Odlum
2,565,961 A 8/1951 Godfrey
2,649,176 A 8/1953 Winger
2,720,296 A 10/1955 Briglia
2,799,194 A 6/1957 Hall
3,222,943 A 12/1965 Mc Donald
3,290,969 A 12/1966 Bergquist
3,802,518 A 4/1974 Albert
4,063,626 A 12/1977 Solomon
4,257,507 A 3/1981 Solomon
4,290,328 A 9/1981 Clark
4,419,911 A 12/1983 Claudy
4,735,120 A 4/1988 Beugelsdyk
4,770,071 A 9/1988 Steier
4,777,852 A * 10/1988 Herman et al. ..... 81/63.1
4,901,607 A 2/1990 Beugelsdyk
5,063,797 A * 11/1991 Huang ..... 81/60
5,069,091 A 12/1991 Bramsiepe
5,379,873 A 1/1995 Shiao
5,520,073 A 5/1996 Bakula
5,535,648 A 7/1996 Braun
5,537,899 A 7/1996 Diedrich
5,570,616 A 11/1996 Thompson
5,573,093 A 11/1996 Lee
5,582,081 A 12/1996 Lin
5,609,078 A 3/1997 Yang
5,642,794 A 7/1997 Chuang
5,685,204 A 11/1997 Braun
5,687,820 A 11/1997 Lin
5,711,193 A 1/1998 Eggert
5,749,272 A 5/1998 Phan
5,836,430 A 11/1998 Vasudeva
5,910,196 A * 6/1999 Huang ..... 81/60
5,974,915 A 11/1999 Chou
6,047,801 A 4/2000 Liao
6,047,802 A * 4/2000 Huang ..... 192/43.2
6,058,812 A 5/2000 Casel
6,070,501 A 6/2000 Braun
6,082,226 A 7/2000 Lin
6,282,990 B1 * 9/2001 Miner ..... 81/63.1

* cited by examiner

RATCHET DRIVER

This application is a continuation of U.S. patent application Ser. No. 10/041,046 filed Jan. 9, 2002 now abandoned.

BACKGROUND

The present invention relates to a hand tool and more particularly to an improved ratchet driver hand tool, such as a screwdriver, which permits the driver to turn in one direction only, in the opposite direction only or both directions. Present ratcheting mechanisms are complicated to use and are expensive to manufacture and assemble.

OBJECTS

The present invention avoids these drawbacks and has for one of its objects the provision of an improved ratcheting mechanism which is simple to use.

Another object of the present invention is the provision of an improved ratcheting mechanism which is simple and inexpensive to assemble and manufacture.

Other and further objects of the invention will be obvious upon an understanding of the illustrative embodiment about to be described, or will be indicated in the appended claims and various advantages not referred to herein will occur to one skilled in the art upon employment of the invention in practice.

DRAWINGS

A preferred embodiment of the invention has been chosen for purposes of illustration and description and is shown in the accompanying drawings forming a part of the specification wherein.

DESCRIPTION

Figure 1:
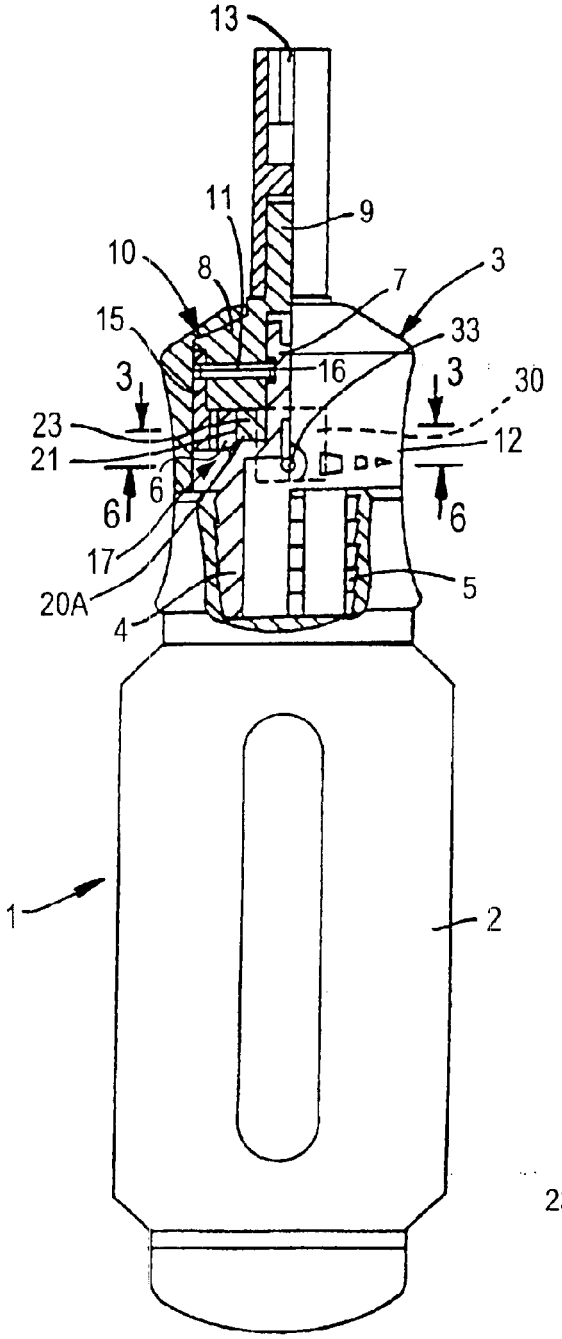
FIG. 1 is a plan view of a ratchet driver hand tool made in accordance with the present invention.
Figure 2:
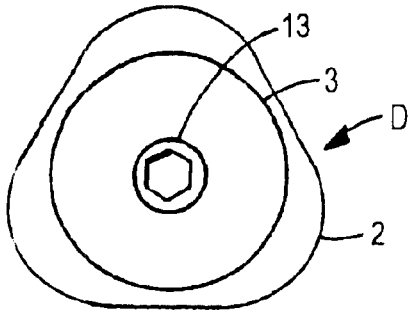
FIG. 2 is a top view thereof.
Figure 7:
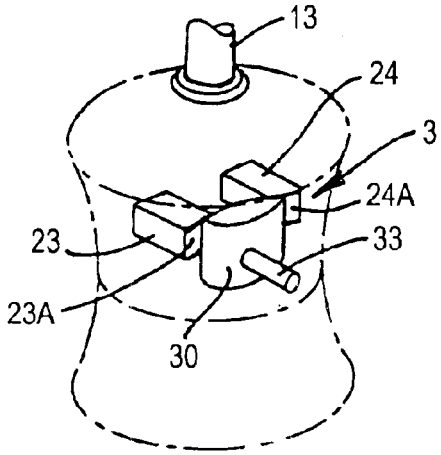
FIG. 7 is a simplified schematic perspective view of the ratchet mechanism of the present invention.
Figure 5:
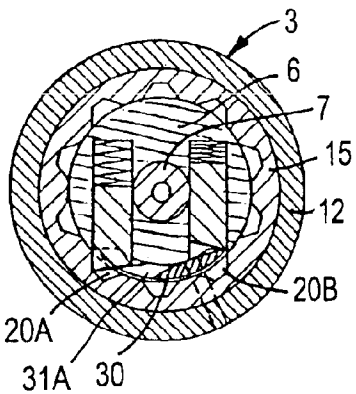
FIG. 5 is a similar sectional view showing the position of the parts when the driver is to rotate in the opposite direction only.
Figure 3:
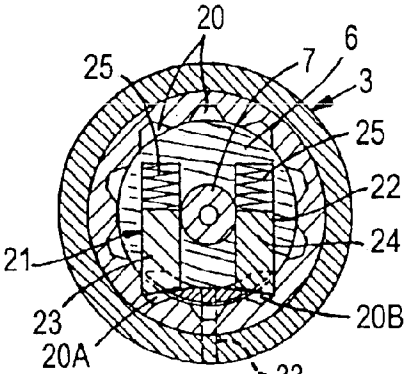
FIG. 3 is a sectional view taken along the lines 3—3 of FIG. 1 showing the position of the parts when the driver is to rotate in both directions.
Figure 4:
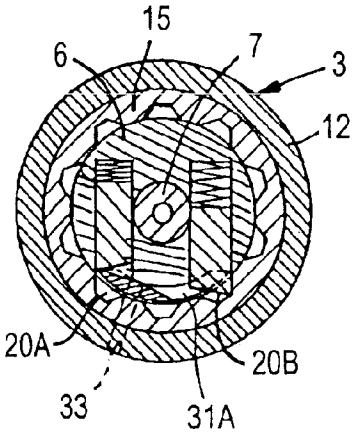
FIG. 4 is a similar sectional view showing the position of the parts when the driver is to rotate in one direction only.
Figure 6:
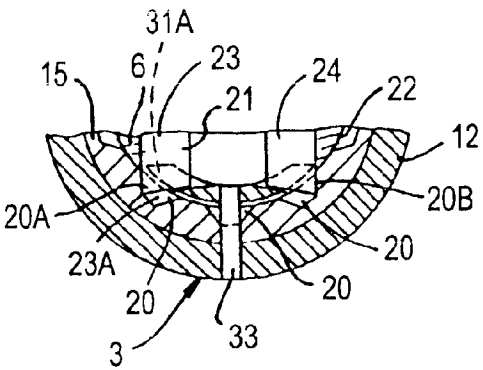
FIG. 6 is a partial and fragmentary sectional view taken along line 6—6 of FIG. 1.

Referring to the drawings, the driver D of the present invention, which may be a screwdriver, comprises a handle 2 and a ratchet control assembly 3 operatively associated with the handle 2 and rotatable relative thereto. The ratchet control assembly 3 comprises a plug 4, mounted in the handle 2 by its foot 5, and an integral head 6 extending above the handle 2. The head 6 comprises an integral upwardly extending neck 7 which has an annular groove 16 therein and an integral ledge 17 is located between the foot 5 and the neck 7 of the ratchet control assembly. A driver assembly 10 is rotatably mounted on the head 6 of the ratchet control assembly 3 and comprises shank 8 and an upstanding stem 9. The stem 9 has an adaptor 13 mounted thereon into which various types of drive bits may be mounted. A ratchet sleeve 15 surrounds the head 6 of the ratchet control assembly 3 and shank 8 of the driver assembly 10 and rests on the said ledge 17. The shank 8 and the ratchet sleeve 15 are connected together by pin 11 so as they can rotate together. The pin 11 extends in the groove 16 to maintain the axial relationship of the ratchet sleeve 15 and the shank 8 and to permit the driver assembly 10 (shank 8 and stem 9) and the ratchet sleeve 15 to rotate together relative to the ratchet control assembly 3 (head 6, neck 7 and ledge 17). An outer cover 12 overlies and is rotatable relative to the ratchet sleeve 15, the shank 8 and the head 6.

The ratchet sleeve 15 has a plurality of control grooves 20 therein opening inwardly along its inner surface. The head 6 has a pair of inwardly extending slots 21 and 22 therein which are preferably parallel to each other. Within each slot 21–22 is mounted a stop slide 23–24, respectively, each of which axe spring biased outwardly toward control grooves 20 in the ratchet sleeve 11 by a spring 25 SO that their outer edges 23A–24A, respectively, enter into two of the grooves 20 (e.g. grooves 20A and 20k) of the ratchet sleeve 15.

Figure 8:
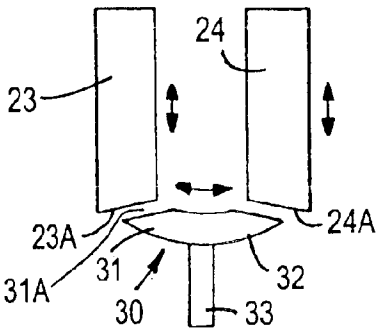
FIG. 8 is another simplified schematic plan view of the ratchet mechanism of the present invention.

A control cam 30 is mounted in an outer groove 31A formed in the head 6 so that it lies between the head 6 and the ratchet sleeve 15 and is movable back and forth within the outer groove 31A along the same plane or path. The control cam 30 is narrow, elongated and curved with tapered outer ends 31 and 32 (FIG. 8). The control cam 30 has a pin 33 which extends outwardly from its lower end and which extends through the outer cover 12. In order to move the control cam 30 in one direction or the other, the outer cover 12 is rotated in one direction or the other so as to move the control cam 30 in either direction through the intermediation of the pin 33.

The ends 31–32 of the control cam 30 are in front of the outer edges 23A–24A of the stop slides 23–24. The outer edges 23A–24A of the lock slides 23–24 are normally in control grooves 20A and 20B, respectively. When the control cam 30 is moved to one side, its end 31 will press stop slide 23 inwardly into its slot 21 against the pressure of spring 25 so that its front edge 23A is moved out of its control groove 20A. This allows the ratchet sleeve 15, shank 8 and stem 9 to turn in one direction only since the outer edge 24A of the other stop slide 24 is still in the control groove 20B and will permit rotation in that direction only. If the shank 8 and stem 9 is rotated in the opposite direction, it will slide past the control grooves 20 without moving the ratchet sleeve 15. When the control cam 30 is moved to the center, the end 31 is moved away from the outer edge 23A of the stop slide 22 and the spring 25 in slot 21 moves the stop slide 22 outwardly to cause the outer edge 23A to move into control groove 20A. The other stop slide 22 is not affected so that, the outer edge 23A–24A of both stop slides 23–24 are in the control grooves 20A and 20B thereby permitting the shank 8 and stem 9 to move in both directions. When the control cam 30 is moved to the other side, the other stop slide 24 is moved inwardly in slot 22 against the spring 25 by the end 32 of control cam 30 and its front end 24A is moved out of the control groove 20B. Hence, the shank 8 and stem 9 can now rotate in the opposite direction only since the front end 23A of the other stop slide 23 is still in its control groove 20A. The control cam 30 is moved back and forth by rotating the cover 12 back and forth so as to move pin 33 back and forth which carries with it the control cam 30.

It will thus been seen that the present invention provided an improved ratcheting mechanism which is simple to use and which is simple and inexpensive to assemble and manufacture.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A ratchet driver comprising a ratchet control assembly, a driver assembly rotatable relative to said ratchet control assembly, a ratchet sleeve operatively connected to said driver assembly, and surrounding said ratchet control assembly, said ratchet sleeve having a plurality of inwardly facing control openings, including first and second control openings, said ratchet control assembly having first and second slots, said first and second slots being substantially parallel to each other, said first and second slots having first and second stop slides, respectively mounted therein, means for moving said stop slides within said control openings, stop slide control means, means for moving said stop slide control means to a position to move said first stop slide out of a first one of said control and allow the second stop slide to be in a second one of said control openings, said moving means adapted to move stop slide control means to a position to move said second stop slide out of said second one of said control openings and allow the first stop slide to be in said first one of said controls openings and said moving means adapted to move said stop slide control means to a position to allow said first and second stop slides to be in said first and second control openings, said stop slide control means comprises a control cam, said control cam comprises a curved control cam having tapered ends.

2. A ratchet driver as set forth in claim 1 wherein said control cam is moved to one position where one of the ends is in front of said first stop slide and its other end is away from said second stop slide to a second position where both ends are away from said first and second stop slide to a third position where said second cam end is in front of the second stop slide and away from the front of the first stop slide.

3. A ratchet driver as set forth in claim 2, wherein said second position comprises a position between said first and third positions.

4. A ratchet driver as set forth in claim 3, wherein said control assembly comprises an upwardly extending head portion and wherein said slots are in said head portion.

5. A ratchet driver as set forth in claim 4, wherein said slots are substantially parallel to each other.

6. A ratchet driver as set forth in claim 5, wherein said ratchet sleeve is mounted around the said head and said driver assembly.

7. A ratchet driver as set forth in claim 6, wherein said head has a ledge extending therefrom and wherein said ratchet sleeve rests on said ledge.

8. A ratchet driver as set forth in claim 7, wherein a pin extends from said control cam, said pin being adapted to control the movement of the control cam.

9. A ratchet driver as set forth in claim 8, wherein an outer cover overlies the driver assembly and the ratchet and wherein said pin extends through said outer cover.

10. A ratchet driver as set forth in claim 9, wherein said driver assembly has a neck and sleeve adapter for driver bits to be attached thereto.

11. A ratchet driver as set forth in claim 10, wherein said means for moving said stop slides are spring means mounted in said slots in order to move said stop slides out of said slots.

* * * * *